US008366103B2

(12) United States Patent
Kimata

(10) Patent No.: US 8,366,103 B2
(45) Date of Patent: Feb. 5, 2013

(54) SHEET POST-PROCESSING APPARATUS

(75) Inventor: Masanobu Kimata, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/929,917

(22) Filed: Feb. 24, 2011

(65) Prior Publication Data

US 2011/0221125 A1 Sep. 15, 2011

(30) Foreign Application Priority Data

Mar. 9, 2010 (JP) ..... 2010-052192

(51) Int. Cl.
*B65H 9/00* (2006.01)

(52) U.S. Cl. ..... 271/236; 271/238; 271/240; 271/253; 271/254; 271/221; 270/58.27

(58) Field of Classification Search ..... 271/233, 271/234, 236, 238, 240, 242, 253, 254, 221, 271/302; 270/46, 48, 51, 58.01, 59, 58.12, 270/58.13, 58.16, 58.17, 58.27, 58.28
See application file for complete search history.

(56) References Cited

U.S. PATENT DOCUMENTS 6,902,162 B2 * 6/2005 Otto et al. ..... 271/207
7,731,187 B2 6/2010 Horio et al.
2007/0176357 A1 8/2007 Horio et al.
2008/0067730 A1 * 3/2008 Suzuki et al. ..... 270/37
2009/0062100 A1 3/2009 Takekawa et al.
2009/0129840 A1 5/2009 Takekawa et al.
2009/0218760 A1 * 9/2009 Kamiya ..... 271/226
2010/0252981 A1 10/2010 Kimata et al.

FOREIGN PATENT DOCUMENTS

JP 3617936 B 11/2004
JP 2007156406 A 6/2007
JP 2009067556 A 4/2009
JP 2010120725 A 6/2010

OTHER PUBLICATIONS

Abstract of JP 2000-327208 published on Nov. 28, 2000.

* cited by examiner

*Primary Examiner* — Michael McCullough
(74) *Attorney, Agent, or Firm* — Harness, Dickey & Pierce

(57) ABSTRACT

A sheet post-processing apparatus includes: a sheet conveying unit that conveys a sheet; a sheet accumulating feed path that is arranged on a downstream side of the sheet conveying unit in a sheet conveying direction and being capable of accumulating therein a plurality of sheets; a stopping member that stops a leading edge of a sheet conveyed into the sheet accumulating feed path; a width aligning unit that aligns a width of the sheet stopped by the stopping member and accumulated in the sheet accumulating feed path; and a control unit that performs control to cause: the sheet conveying unit to convey a sheet into the sheet accumulating feed path; the stopping member to stop the leading edge of the sheet; and the width aligning unit to align the width of a sheet every time a sheet is accumulated in the sheet accumulating feed path.

4 Claims, 9 Drawing Sheets

SHEET POST-PROCESSING APPARATUS

CROSS-REFERENCE TO RELATED APPLICATIONS

The present application claims priority to and incorporates by reference the entire contents of Japanese Patent Application No. 2010-052192 filed in Japan on Mar. 9, 2010.

BACKGROUND OF THE INVENTION

1. Field of the Invention

The present invention generally relates to a sheet post-processing apparatus.

2. Description of the Related Art

Japanese Patent Application Laid-open No. 2009-67556 discloses an example of this type of sheet post-processing apparatus. The apparatus causes the leading edge of a sheet with an image formed thereon that is delivered to abut against a stopper member disposed in a feed path to accumulate the sheet in the feed path and determine a folding position of the sheet. The apparatus then brings a folding blade to abut against the folding position to fold the sheet. The sheet post-processing apparatus also includes a pair of folding rollers including a pair of roller members facing to each other and having a nip portion therebetween facing the edge of the folding blade across the sheet at the folding position. The folding blade is used to press the sheet, kept abutting against the stopper member, from the direction approximately perpendicular to the sheet surface, to cause the sheet to be folded in an L shape when viewed from the side. The sheet is then further pressed into the nip portion of the pair of folding rollers to be folded at a desired folding position.

To fold a plurality of stacked sheets, the sheets to be stacked and to be folded together are sequentially brought to abut against a stopper one after another, so that the sheets thus stacked are accumulated in the feed path. After accumulating a predetermined number of sheets in the feed path, a width aligning unit for aligning the sheet bundle in the width direction presses the sheet bundle on both ends thereof in the width direction to align the sheet bundle in the width direction. After aligning the sheet bundle in the width direction, the folding blade presses the sheet bundle into the nip portion of the pair of folding rollers to fold the bundle of the stacked sheets.

However, as the number of sheets accumulated in the feed path increases, the resistance between the sheets in the bundle also increases. Thus, it will be more difficult to move the sheets in the width direction upon aligning the width of the sheet bundle simply by pressing the sheet bundle on both ends thereof using the width aligning unit in the width direction. Therefore, the width of the sheet bundle may not be aligned precisely.

In Japanese Patent Application No. 2008-294436, the applicant of the present application suggested a sheet post-processing apparatus including a stacking disordering prevention mechanism, so that a plurality of sheets is stacked in the order in which the sheets are sent into the feed path upon conveying the sheets to abut against a stopper and to accumulate the sheets in the feed path. The stacking disordering prevention mechanism includes a pair of carriage rollers, and a pressing claw for pressing the trailing edge of accumulated sheets while covering it, at a position on the downstream side of the pair of carriage rollers in the sheet conveying direction. One end of the pressing claw is rotatably supported on a frame, and the other end thereof is displaceable between a position to block the feed path and another position escaped from the blocking position. A pulling coil spring keeps the other end of the pressing claw at the position to block the feed path. The biasing force of the pulling coil spring is set to a level by which the pressing claw is rotated in the opposite direction of the biasing direction of the pulling coil spring when the pressing claw is pressed by a sheet conveyed into the feed path, and escapes from the position to block the feed path so as to open the feed path. The sheet can reach the position of the stopper because the leading edge of the sheet conveyed into the feed path and conveyed by the pair of carriage rollers included in the stacking disordering prevention mechanism abuts against the pressing claw, pushes the pressing claw away, and moves toward the downstream side in the sheet conveying direction.

As the sheet pushes the pressing claw away and the trailing edge of the sheet passes through the pressing claw, the pulling coil spring moves the pressing claw to the position to block the feed path, and the pressing claw presses the trailing edge of the sheet in the manner covering it. When the second sheet is conveyed into the feed path, the pressing claw presses the trailing edge of the first sheet while covering it. Therefore, the second sheet passes through and is carried through the pressing claw in a manner overlapping the first sheet. The same operation is performed for the third and subsequent sheets to stack the sheets in the order in which the sheets are conveyed into the feed path.

Once the trailing edge of the sheet pushing the pressing claw away passes through the pair of carriage rollers included in the stacking disordering prevention mechanism, the sheet is carried toward the downstream side in the sheet conveying direction toward the stopper by its own weight. The trailing edge of the sheet, to which the power to go forward is no longer applied by the pair of carriage rollers, then fails to pass through the pressing claw only by its own weight, and the leading edge of the next sheet conveyed into the feed path may collide with the trailing edge to cause jamming.

Moreover, the sheet whose trailing edge has passed through the pair of carriage rollers in the stacking disordering prevention mechanism may be skewed or the leading edge of the sheet may fail to reach the stopper because the sheet is carried by its own weight. In response to this issue, a length aligning unit is optionally used for aligning a predetermined number of sheets accumulated in the feed path in the length direction (in the sheet conveying direction) by pushing the trailing edge of the sheet bundle, so that the leading edge of the sheets surely abuts against the stopper and the sheet bundle is aligned in the length direction. However, as the number of sheets accumulated in the feed path increases, the resistance between the sheets in the bundle also increases. Thus, it is more difficult to move the sheets in the length direction upon aligning the sheet bundle in the length direction simply by pressing the trailing edge the sheet bundle using the length aligning unit. Therefore, the sheet bundle may not be aligned precisely in the length direction.

In other words, when the sheet bundle is aligned in the width direction and the length direction after a predetermined number of sheets is accumulated in the feed path, the sheets may not be aligned precisely in the width direction and the length direction because the resistance between the sheets in the bundle increases as the number of sheets accumulated in the feed path increases. If the sheet bundle fails to be aligned precisely in the width direction and the length direction, the sheets may be folded at deviated folding positions while being stacked and folded.

SUMMARY OF THE INVENTION

It is an object of the present invention to at least partially solve the problems in the conventional technology.

According to an aspect of the present invention, there is provided a sheet post-processing apparatus that performs a predetermined post-process to a sheet delivered from an image forming apparatus and accumulated temporarily, the sheet post-processing apparatus including: a sheet conveying unit that conveys a sheet; a sheet accumulating feed path that is arranged on a downstream side of the sheet conveying unit in a sheet conveying direction and being capable of accumulating therein a plurality of sheets; a stopping member that stops a leading edge of a sheet conveyed into the sheet accumulating feed path; a width aligning unit that aligns a width of the sheet stopped by the stopping member and accumulated in the sheet accumulating feed path; and a control unit that performs control to cause: the sheet conveying unit to convey a sheet into the sheet accumulating feed path; the stopping member to stop the leading edge of the sheet; and the width aligning unit to align the width of a sheet every time a sheet is accumulated in the sheet accumulating feed path.

According to another aspect of the present invention, there is provided an image forming apparatus including: an image forming unit that forms an image of an original onto a sheet; a sheet feeding unit that stores therein a sheet to be supplied to the image forming unit, and a sheet post-processing apparatus that performs a predetermined post-process to the sheet, wherein the sheet post-processing apparatus comprising: a sheet conveying unit that conveys the sheet; a sheet accumulating feed path that is arranged on a downstream side of the sheet conveying unit in a sheet conveying direction and being capable of accumulating therein a plurality of sheets; a stopping member that stops a leading edge of a sheet conveyed into the sheet accumulating feed path; a width aligning unit that aligns a width of the sheet stopped by the stopping member and accumulated in the sheet accumulating feed path; and a control unit that performs control to cause: the sheet conveying unit to convey a sheet into the sheet accumulating feed path; the stopping member to stop the leading edge of the sheet; and the width aligning unit to align the width of a sheet every time a sheet is accumulated in the sheet accumulating feed path.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of the present invention is explained below in greater detail with reference to the accompanying drawings.

Figure 1:
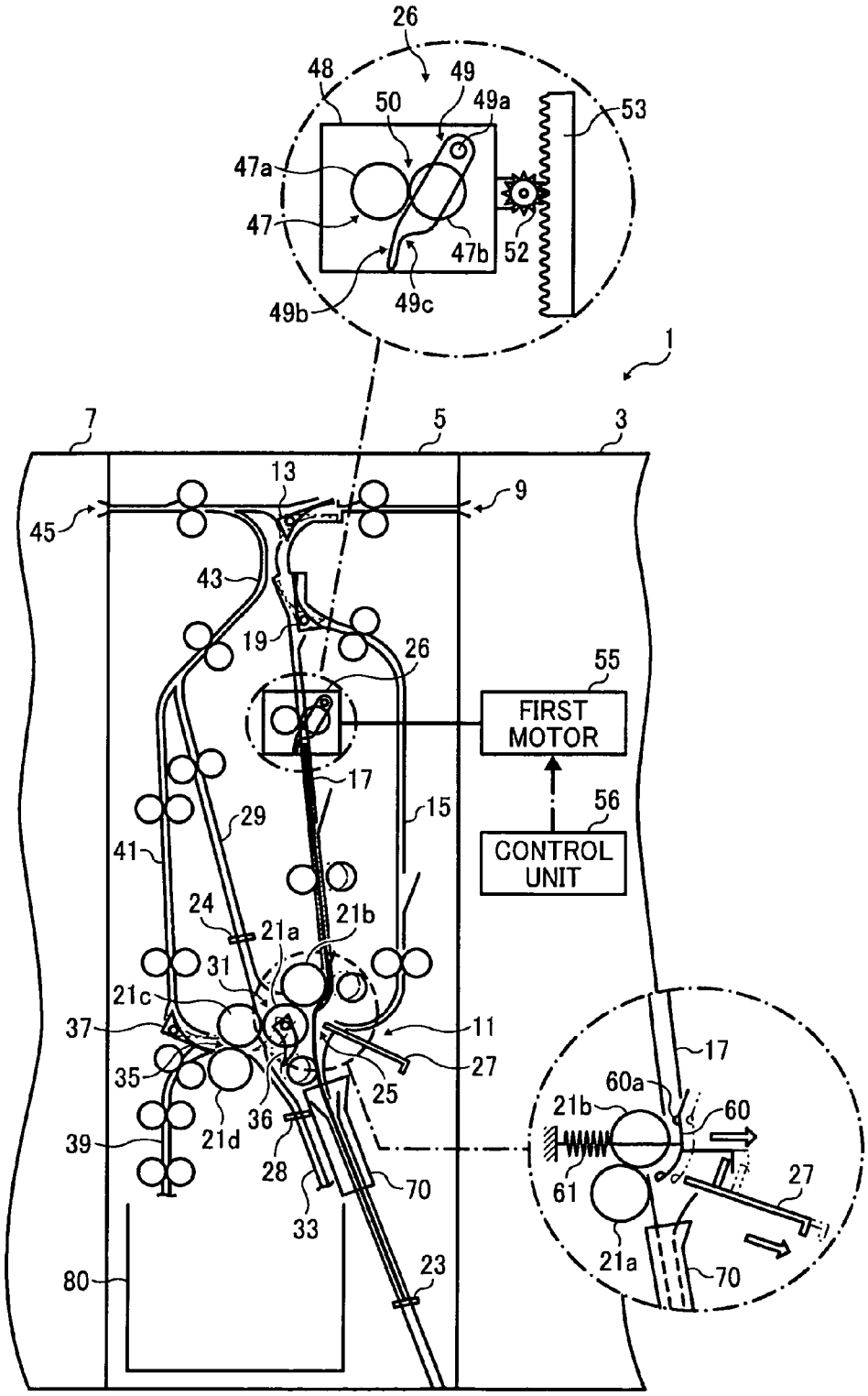
FIG. 1 is a schematic of a sheet bundle accumulated in a second feed path.

An image forming apparatus 1 according to the embodiment includes, as illustrated in FIG. 1, an image forming apparatus body 3 that is a copying machine, a sheet folding apparatus 5, and a sheet binding apparatus 7 that is a sheet post-processing apparatus.

The image forming apparatus body 3 includes an image scanning unit (not illustrated) for reading an image of an original, an image forming unit (not illustrated) that forms the image of the original read by the image scanning unit onto a sheet, a sheet feeding unit (not illustrated) that stores therein sheets to be supplied to the image forming unit, a discharging unit (not illustrated) onto which the sheet with an image formed thereon by the image forming unit is discharged, a control unit 56 that controls each of the units included in the main apparatus, and an operation panel (not illustrated) that transmits operation signals to the control unit 56.

The sheet folding apparatus 5 is disposed on one side of the image forming apparatus body 3, and provides various folding operations to sheets on which images are formed by the image forming apparatus body 3.

The sheet folding apparatus 5 has a sheet receiving opening 9 through which the sheet after image formation is received from the image forming apparatus body 3. A first switching claw 13 is arranged downstream of the sheet receiving opening 9 in the sheet conveying direction to switch the direction for conveying the sheet between a sheet folding unit 11 and the sheet binding apparatus 7.

A second switching claw 19 is arranged on the downstream side of the first switching claw 13 in the sheet conveying direction directed toward the sheet folding unit 11 to switch the direction for conveying the sheet between a first feed path 15 and a second feed path 17 also functioning as a sheet accumulating unit.

A downstream end of the first feed path 15 in the sheet conveying direction is merged into the second feed path 17. A first pair of folding rollers including a folding roller 21*a* and a folding roller 21*b* is arranged near the merging area.

A first stopper 23 being movable in the sheet conveying direction and for stopping the leading edge of a sheet is arranged on the downstream side in the second feed path 17 in the sheet conveying direction to accumulate the sheet in the second feed path 17.

Figure 2:
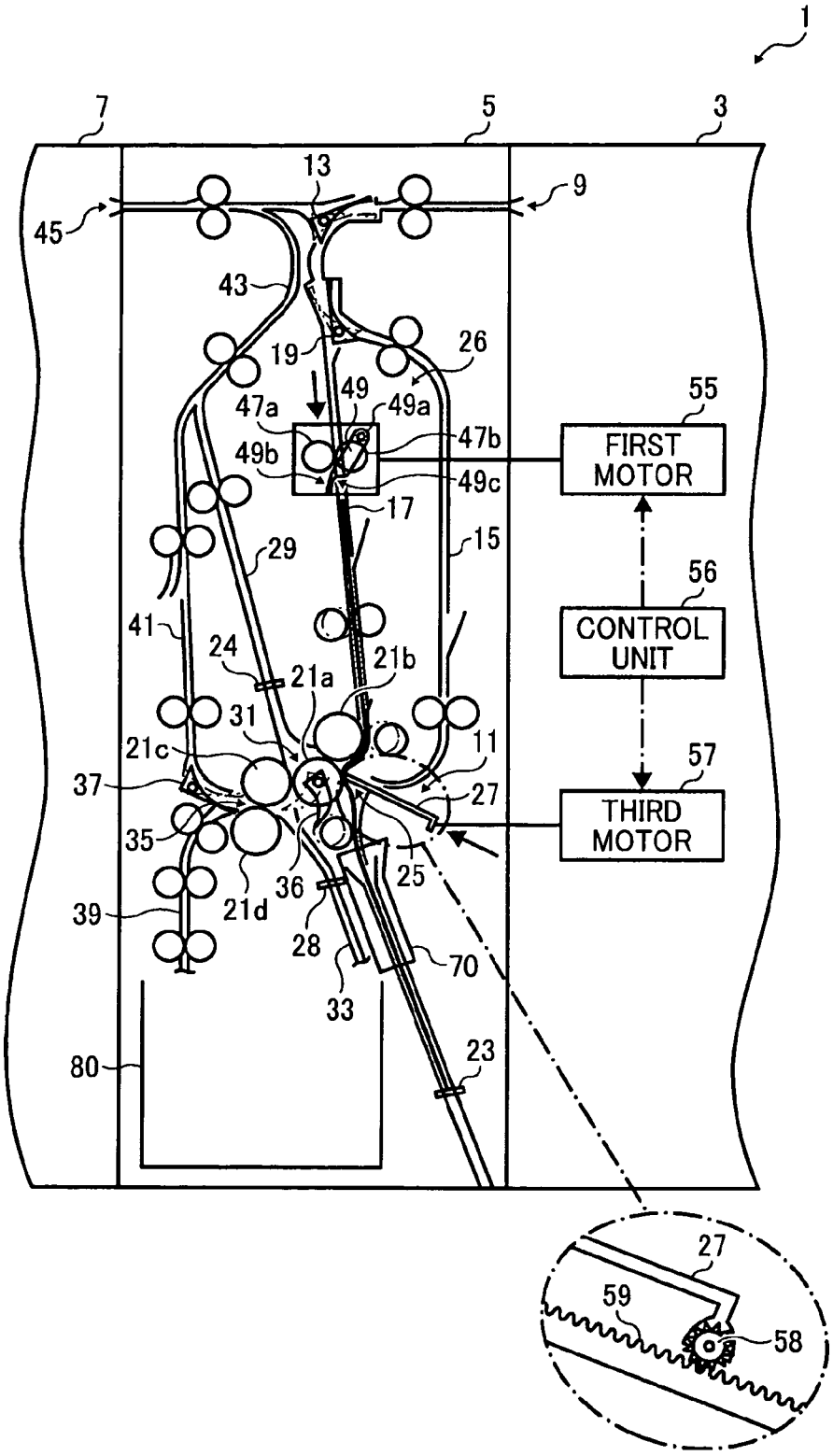
FIG. 2 is a schematic of the trailing edge of a sheet bundle being pressed to have a bent portion, and guided into a first folding nip using a pushing member.

At a position facing a first folding nip 25 of the first pair of folding rollers including the folding roller 21*a* and the folding roller 21*b*, a pushing member 27 is arranged as illustrated in FIG. 2. The pushing member 27 guides the leading edge of the sheet conveyed through the first feed path 15 into the first folding nip 25, and also pushes the sheets accumulated in the second feed path 17 into the first folding nip 25. A pinion 58 is rotatably supported about the end of the pushing member 27 on the opposite side of the first folding nip 25, and is engaged with a rack 59 arranged along the longitudinal direction of the pushing member 27. The pinion 58 is connected to a third motor 57, and the third motor 57 is controlled by the control unit 56. The third motor 57 is driven to rotate the pinion 58 on the rack 59 to move the pushing member 27 closer to the first folding nip 25 or further away from the first folding nip 25.

A moving roller unit 26 for conveying a sheet is arranged in the second feed path 17 between the second switching claw 19 and the first folding nip 25.

A third feed path 29 and a second pair of folding rollers including the folding roller 21*a* and a folding roller 21*c* are arranged on the downstream side of the first folding nip 25 in the sheet conveying direction.

A fourth feed path 33, and a third pair of folding rollers formed of the folding roller 21*c* and a folding roller 21*d* are arranged on the downstream side of a second folding nip 31, the second pair of folding rollers formed of the folding roller 21*a* and the folding roller 21*c*, in the sheet conveying direction.

A third switching claw 36 for switching the direction for conveying the sheet between the fourth feed path 33 and a third folding nip 35 of the third pair of folding rollers, which is formed of the folding roller 21*c* and the folding roller 21*d*, is arranged on the shaft of the folding roller 21*a*.

A fourth switching claw 37 for switching the direction to convey the sheet between a fifth feed path 39 and a sixth feed path 41 is arranged on the downstream side of the third folding nip 35 in the sheet conveying direction.

The downstream end of the fifth feed path 39 in the sheet conveying direction is connected to a stacker 80.

The end of the downstream side of the sixth feed path 41 in the sheet conveying direction is merged into the end of the downstream side of the third feed path 29 in the sheet conveying direction, and is communicated to a seventh feed path 43. The seventh feed path 43 is communicated to a sheet discharging opening 45. The sheet discharging opening 45 is connected to the sheet binding apparatus 7.

Each of the first feed path 15, the second feed path 17, the third feed path 29, the fifth feed path 39, the sixth feed path 41, and the seventh feed path 43 includes a pair of carriage rollers for conveying the sheet.

A second stopper 24 being displaceable between a position to block the third feed path 29 and a position escaped from the blocking position to open the third feed path 29 as well as being movable in the third feed path 29 along the sheet conveying direction is arranged in the third feed path 29. A third stopper 28 being movable in the fourth feed path 33 along the sheet conveying direction is arranged in the fourth feed path 33.

Figure 3A:
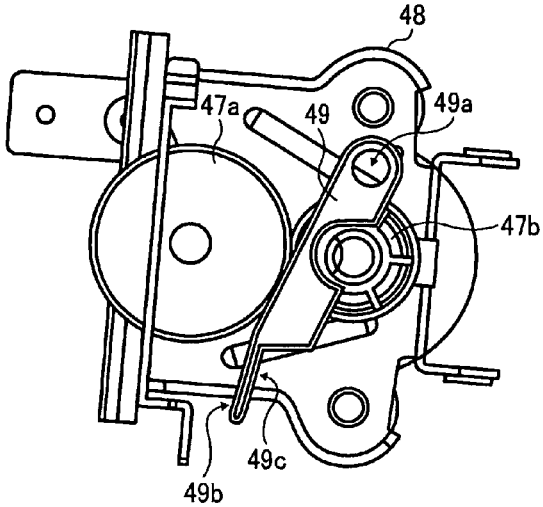
FIG. 3A is a schematic of a moving roller unit viewed from the axial direction.
Figure 3B:
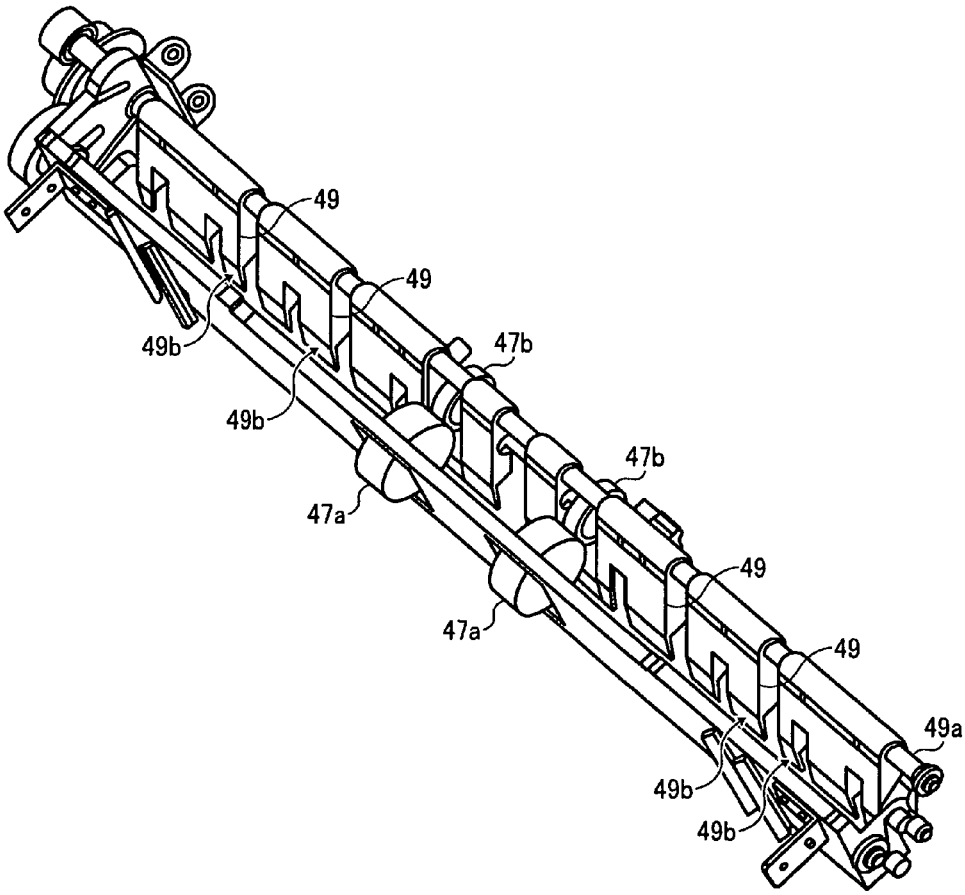
FIG. 3B is a perspective view of the moving roller unit viewed from the side of a rubber carriage roller 47*a;*
Figure 3C:
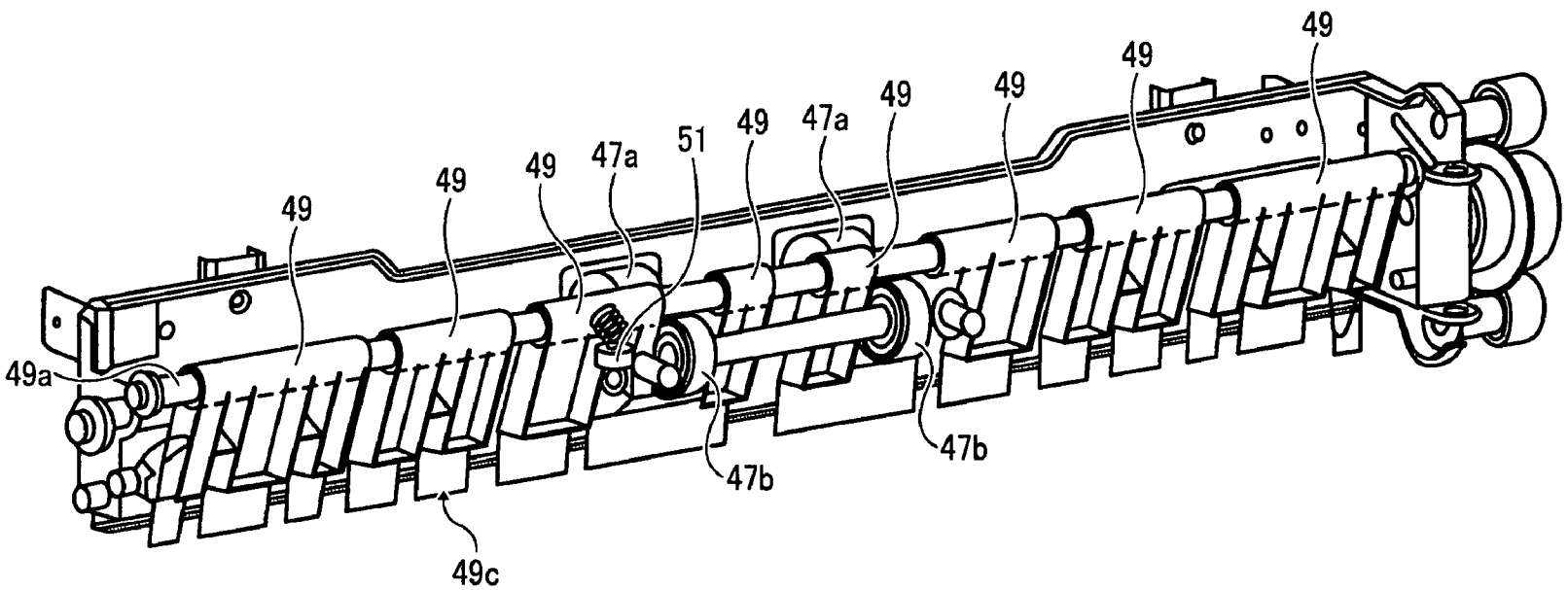
FIG. 3C is a perspective view of the moving roller unit viewed from the side of a rubber carriage roller 47*b;*

FIG. 3A is a schematic of the moving roller unit 26 viewed from the axial direction. FIG. 3B is a perspective view of the moving roller unit 26 viewed from the side of a rubber carriage roller 47*a*. FIG. 3C is a perspective view of the moving roller unit 26 viewed from the side of a rubber carriage roller 47*b*.

The moving roller unit 26 includes a pair of carriage rollers 47 having rollers pressed against each other that is a rubber carriage roller 47*a* being a driving roller and a rubber carriage roller 47*b* being a driven roller, a pressing member 49 that holds down the trailing edge of a sheet accumulated in the second feed path 17, and a frame 48 holding each of these components. The moving roller unit 26 functions as a stacking disordering prevention mechanism for preventing the sheets from being stacked in an order other than the order in which the sheets are conveyed into the feed path.

Each of the rubber carriage roller 47*a* and the rubber carriage roller 47*b* includes a plurality of roller parts arranged with a space therebetween along the sheet width direction and along the same axial direction. The shaft of the rubber carriage roller 47*a* and the shaft of the rubber carriage roller 47*b* are rotatably supported on the frame 48.

The pressing member 49 is arranged in plurality with a space therebetween on a supporting member, which is disposed in parallel with the pair of rubber carriage rollers 47 having the rubber carriage roller 47*a* and the rubber carriage roller 47*b*, and laid in a manner inserted between their adjacent roller parts.

Figure 4:
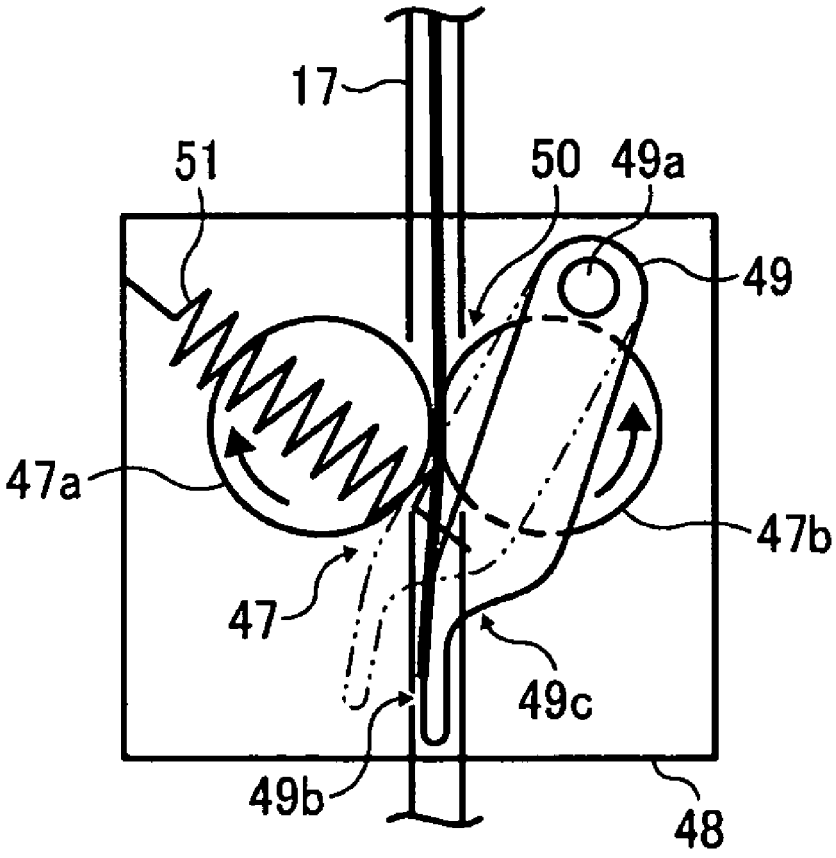
FIG. 4 is an enlarged view of the moving roller unit.

A base portion 49*a* of the pressing member 49 is supported by the frame 48 in a rotatable manner as illustrated in FIG. 4. The base portion 49*a* is positioned on the side of the rubber carriage roller 47*b*, and the pressing member 49 is biased by a pulling coil spring 51 fixed on the frame 48 toward the side of the rubber carriage roller 47*a*.

A stopper member (not illustrated) restricts the rotation of the pressing member 49 toward the rubber carriage roller 47*a*, and the pressing member 49 is kept at a position to block the second feed path 17 as illustrated in a long dashed double-short dashed line in FIG. 4.

The biasing force (spring constant) of the pulling coil spring 51 is set to a level to cause the pressing member 49 to rotate in the opposite direction of the biasing direction of the pulling coil spring 51 when a sheet conveyed through the second feed path 17 pushes the pressing member 49, so that the second feed path 17 is opened.

A guiding surface 49*b* for guiding a sheet conveyed through the second feed path 17 toward the side of the sheets already accumulated in the second feed path 17 is formed on the edge of the pressing member 49 and on the side near the rubber carriage roller 47*a*. A pressing surface 49*c* for pressing the trailing edge of the sheet bundle accumulated in the second feed path 17 is formed on the edge of the pressing member 49 and on the side away from the rubber carriage roller 47*a*.

As illustrated in FIG. 1, a pinion 52 is rotatably supported on a side of the frame 48, and engages with a rack 53 disposed along the sheet conveying direction. The pinion 52 is connected to a first motor 55 that is a first driving unit, and the control unit 56 controls the first motor 55. The first motor 55 is driven to rotate the pinion 52 on the rack 53 to move the moving roller unit 26 toward the downstream side or the upstream side in the sheet conveying direction along the second feed path 17.

A movable guide plate 60 for guiding a sheet to the first stopper 23 is arranged near the first pair of folding rollers including the folding roller 21*a* and the folding roller 21*b* in the second feed path 17. The guide plate 60 has a protrusion 60*a*, and is biased by a pulling spring 61 toward a guide plate not illustrated.

During single sheet folding, the position of the guide plate 60 is determined by the position at which the protrusion 60*a* abuts against the guide plate not illustrated. On the contrary, during stacked sheet folding for folding multiple sheets, the pushing member 27 moves from the position illustrated in the solid line in FIG. 1 to the position illustrated in the dotted line, thereby causing the guide plate 60 to be pulled from the position illustrated in the solid line in FIG. 1 to the position illustrated in the dotted line, and to be moved in parallel from the position for the single sheet folding. By moving the guide plate 60 in parallel, the space between the outer circumferential surface of the folding roller 21*b* and the guide plate 60 (conveying space) used during the single sheet folding is kept constant.

The space between the surface of the folding roller 21*b* and the edge of the pushing member 27 through which a sheet passes can be changed arbitrarily because a stepping motor allowing a stop position to be optionally set is used for the pushing member 27.

On the contrary, the space between the folding roller 21*b* and the guide plate 60 is enabled to be set optionally depending on the number of stacked sheets to be folded together when a plurality of stacked sheets is folded together. For example, when the number of stacked sheets to be folded together is equal to or less than five, the space between the folding roller 21*b* and the guide plate 60 is set to three millimeters. When the number of stacked sheets to be folded together is equal to or more than six and equal to or less than ten, the space between the folding roller 21*b* and the guide plate 60 is set to four millimeters. When the number of stacked sheets to be folded together is equal to or more than ten and equal to or less than twenty, the space between the folding roller 21*b* and the guide plate 60 is set to six millimeters. In this manner, the space between the folding roller 21*b* and the guide plate 60 is increased as the number of stacked sheets to be folded together is increased.

The sheet binding apparatus 7 includes a staple tray for stacking thereon sheets and a stapler for stapling a bundle of sheets stacked on the staple tray, and binds the sheet bundle at an end thereof on the staple tray as required.

Various single sheet folding or stacked sheet folding can be selected on the operation panel of the image forming apparatus body 3.

An operation of the sheet folding apparatus 5 will now be explained. A user selects half folding and stacked sheet folding on the operation panel of the image forming apparatus body 3. The control unit 56 sets the sheet receiving position of the first stopper 23 to make the distance between the first folding nip 25 and the first stopper 23 one half of the length of the sheet in the conveying direction, and sets the distance between the first stopper 23 and the pressing surface 49*c* of the pressing member 49 to a length slightly longer than the length of the sheet in the conveying direction. In this manner, the sheets can be folded without conveying the sheet bundle any further after the sheets are accumulated.

When a user selects the stacked sheet folding and three-folded or Z-folded, the control unit 56 moves the first stopper 23 correspondingly to the folding position, and makes the distance between the first stopper 23 and the pressing surface 49*c* slightly longer than the length of the sheet in the conveying direction in the same manner as in the half folding. The pushing member 27 is moved to the escaped position (the dotted line in FIG. 1) to move the guide plate 60 in a direction to increase the conveying space (the dotted line in FIG. 1).

A sheet with an image formed thereon is delivered from the image forming apparatus body 3 through the sheet receiving opening 9. The first switching claw 13 and the second switching claw 19 guide the delivered sheet to the second feed path 17. The leading edge of the sheet then enters a conveying nip 50 of the pair of rubber carriage rollers 47 including the rubber carriage roller 47*a* and the rubber carriage roller 47*b*. The sheet then passes through the conveying nip 50, abuts against the guiding surface 49*b* of the pressing member 49, pushes the pressing member 49 away, and is carried downstream in the sheet conveying direction through the second feed path 17 (see the state (a) in FIG. 5).

After the trailing edge of the sheet passes through the conveying nip 50 of the pair of rubber carriage rollers 47 including the rubber carriage roller 47*a* and the rubber carriage roller 47*b*, the sheet passes through the guide plate 60 by its own weight, and slides down until the leading edge of the sheet abuts against the first stopper 23. At this time, there are some cases in which the trailing edge of the sheet stops at a position where the leading edge of the sheet passes through the conveying nip 50 of the pair of rubber carriage rollers 47 including the rubber carriage roller 47*a* and the rubber carriage roller 47*b*, without the leading edge of the sheet reaching the first stopper 23 (see the state (b) in FIG. 5).

After the leading edge of the sheet reaches the first stopper 23, a jogger 70 is moved from its receiving position (a position away from the sheet width by seven millimeters) to the position of the sheet width to align the sheet in the width direction.

Figure 6A:
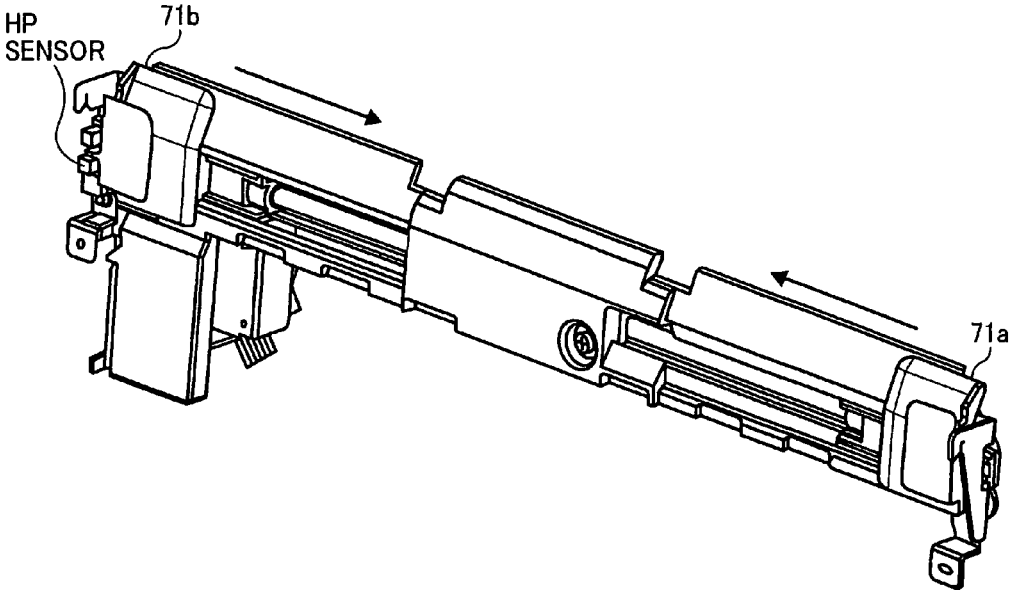
FIG. 6A is a perspective view of a jogger viewed from the front side.
Figure 6B:
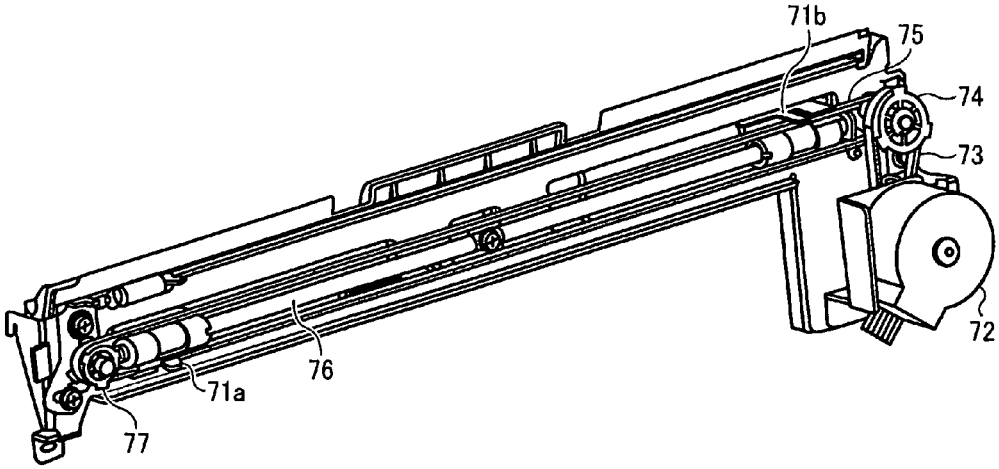
FIG. 6B is a perspective view of the jogger viewed from the rear side.

FIG. 6A is a perspective view of the jogger 70 viewed from the front side, and FIG. 6B is a perspective view of the jogger 70 viewed from the rear side.

When the control unit sends a signal to a jogger motor 72, the jogger motor 72 is rotated to rotate a timing pulley (not illustrated) across which a timing belt 73 is stretched and that is attached to the rotating shaft of the jogger motor 72. As the timing pulley is rotated, the timing belt 73 is driven, and the power is communicated to a two-staged timing pulley 74 across which the timing belt 73 is stretched in the same manner as the above timing pulley. The two-staged timing pulley 74 has two stages of communicating portions for communicating the driving power of the belt, and is capable of communicating the power communicated from the timing belt 73 to a timing belt 75 stretched across the two-staged timing pulley 74 and a timing pulley 77. As the two-staged timing pulley 74 is rotated, the power is communicated to the timing belt 75, and a jogger fence 71*a* and a jogger fence 71*b* both of which are attached to the timing belt 75 are moved synchronously. When the timing belt 75 rotates in the counterclockwise direction in FIG. 6B, the jogger fence 71*a* and the jogger fence 71*b* are moved closer to each other toward the center in the axial direction. When the timing belt 75 rotates in the clockwise direction in FIG. 6B, the jogger fence 71*a* and the jogger fence 71*b* are moved away from each other toward the edges in the axial direction. The jogger fence 71*a* and the jogger fence 71*b* are slidably attached to a guiding shaft 76, and movements of the jogger fence 71*a* and the jogger fence 71*b* are restricted by the guiding shaft 76.

At the operational timing at which the trailing edge of the sheet passes through the pair of rubber carriage rollers 47, the control unit 56 rotates the first motor 55 in the positive direction to move up the moving roller unit 26 to a position 36.5 millimeters higher than the receiving position (toward the upstream side in the sheet conveying direction). The control unit 56 then stops moving the moving roller unit 26 at the point when the edge of the pressing member 49 is at a position 7 millimeters higher than the trailing edge of the sheet (see the state (c) in FIG. 5).

Figure 5:
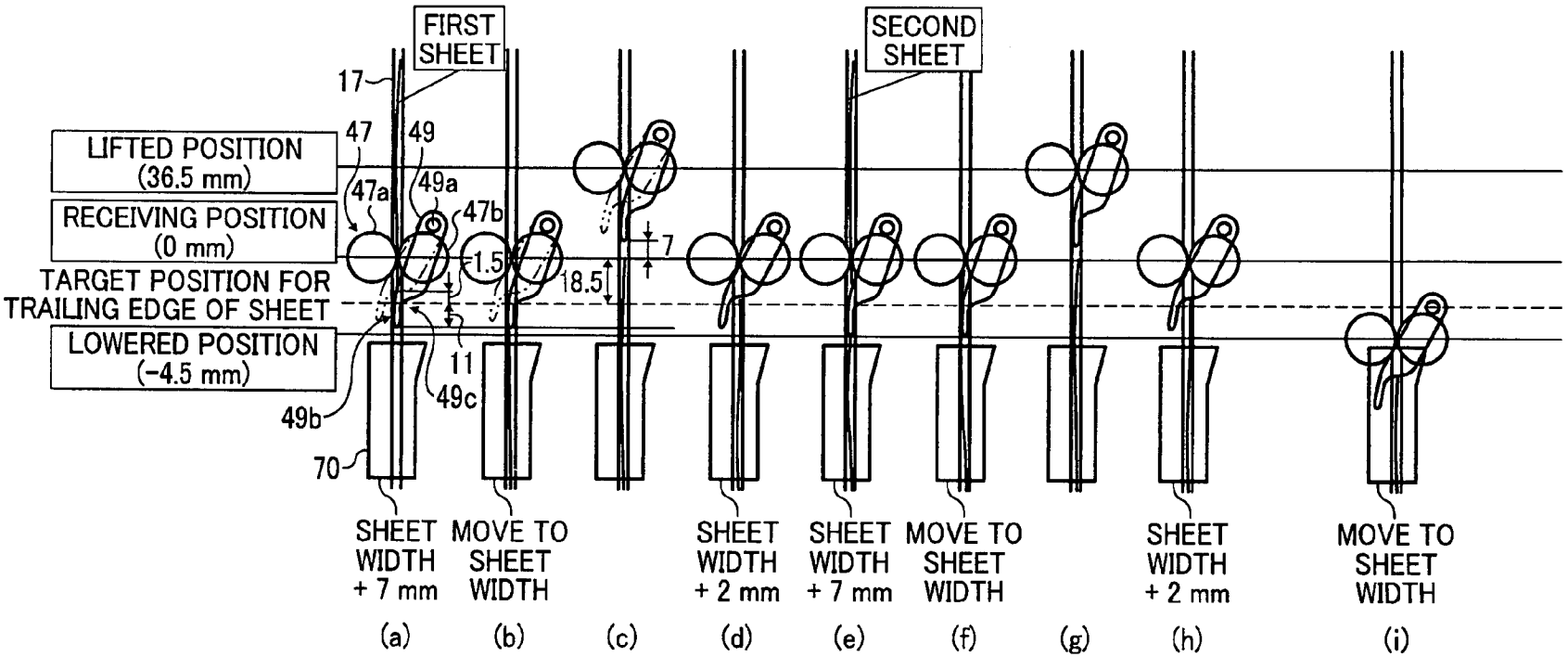
FIG. 5 is a schematic of an operation of the moving roller unit performed when the sheet is conveyed into the second feed path.

When 50 milliseconds elapse from the time when the moving roller unit 26 is stopped, the control unit 56 drives the first motor 55 in the reverse direction to move down the moving roller unit 26 by 36.5 millimeters (toward the downstream side in the sheet conveying direction), and carries the sheet until the leading edge of the sheet abuts against the first stopper 23 by pushing the trailing edge of the sheet with the pressing surface 49*c* of the pressing member 49 (see the state (d) in FIG. 5).

If the leading edge of the sheet has reached the first stopper 23, it is not necessary to press the trailing edge of the sheet using the pressing surface 49*c* of the pressing member 49. However, if the leading edge of the sheet has not reached the first stopper 23, the pressing surface 49*c* of the pressing member 49 functions as an aligning unit for aligning the sheet in the sheet conveying direction.

In addition, the jogger 70 is moved to a position away from the sheet width by two millimeters to guide the sheet in the sheet conveying direction, so that the sheet is not skewed when the trailing edge of the sheet is pressed with the pressing surface 49*c* of the pressing member 49.

When the moving roller unit 26 receives the second sheet conveyed thereto as illustrated in the state (e) in FIG. 5, the leading edge of the sheet passed through the conveying nip 50 of the pair of rubber carriage rollers 47 including the rubber carriage roller 47*a* and the rubber carriage roller 47*b* abuts against the guiding surface 49*b* on the pressing member 49, and pushes the pressing member 49 away to move forward as illustrated in the state (f) in FIG. 5 in the same manner as the first sheet.

At this time, because the trailing edge of the first sheet is covered by the edge of the pressing member 49, the leading edge of the second sheet is guided by the guiding surface 49*b* and conveyed toward the side of the first sheet without abutting against the trailing edge of the first sheet (accumulated sheet).

At the operational timing at which the trailing edge of the sheet passes through the pair of rubber carriage rollers 47, the control unit 56 rotates the first motor 55 in the positive direction to move up the moving roller unit 26 to a position 36.5 millimeters higher than the receiving position (toward the upstream side in the sheet conveying direction), and then stops moving the moving roller unit 26 (see the state (g) in FIG. 5).

At the time when 50 milliseconds elapse since the moving roller unit 26 was stopped, the control unit 56 drives the first motor 55 in the reverse direction to move down the moving roller unit 26 by 36.5 millimeters (toward the downstream side in the sheet conveying direction), and carries the sheet until the leading edge of the sheet abuts against the first stopper 23 by pushing the trailing edge of the sheet with the pressing surface 49*c* of the pressing member 49 (see the state (h) in FIG. 5).

The control unit 56 moves the moving roller unit 26 at the same operational timings for the third and subsequent sheets, thereby accumulating the sheets in the second feed path 17.

For the stacked sheet folding, the driven roller of the pair of carriage rollers arranged in the second feed path 17 is kept at a standby position away from the carriage roller facing thereto so as not to apply any power to go forward to the sheet as illustrated in FIG. 1.

After accumulating a desired number of sheets in the second feed path 17, the control unit 56 rotates the first motor 55 in the reverse direction to move the moving roller unit 26 to a position 4.5 millimeters lower than the receiving position, so that the sheet bundle is aligned by the pressing surface 49*c* of the pressing member 49 in the length direction (sheet conveying direction), while causing the jogger 70 to align the sheets in the sheet width direction (see the state (i) in FIG. 5).

The control unit 56 then drives the pushing member 27 to push the bent portion of the sheet bundle into the first folding nip 25 to fold the sheet bundle. As the pushing member 27 moves toward the first folding nip 25, the guide plate 60 is pulled by the spring force of the pulling spring 61 to return to the position for the single sheet folding (the position illustrated in the solid line in FIG. 1).

At this time, each moving speed of the pressing member 49 and the pushing member 27 is set to a speed higher than the linear speed of the folding roller 21*a* and the folding roller 21*b* included in the first pair of folding rollers, e.g., a speed of a predetermined range between 1.1 times to 1.5 times of the linear speed of the folding roller 21*a* and the folding roller 21*b*. In this manner, the pressing member 49 and the pushing member 27 can be pressed against the sheet bundle more reliably. The range between 1.1 times to 1.5 times of the linear speed mentioned above is just an example, and the present invention is not limited to such a range.

Figure 7:
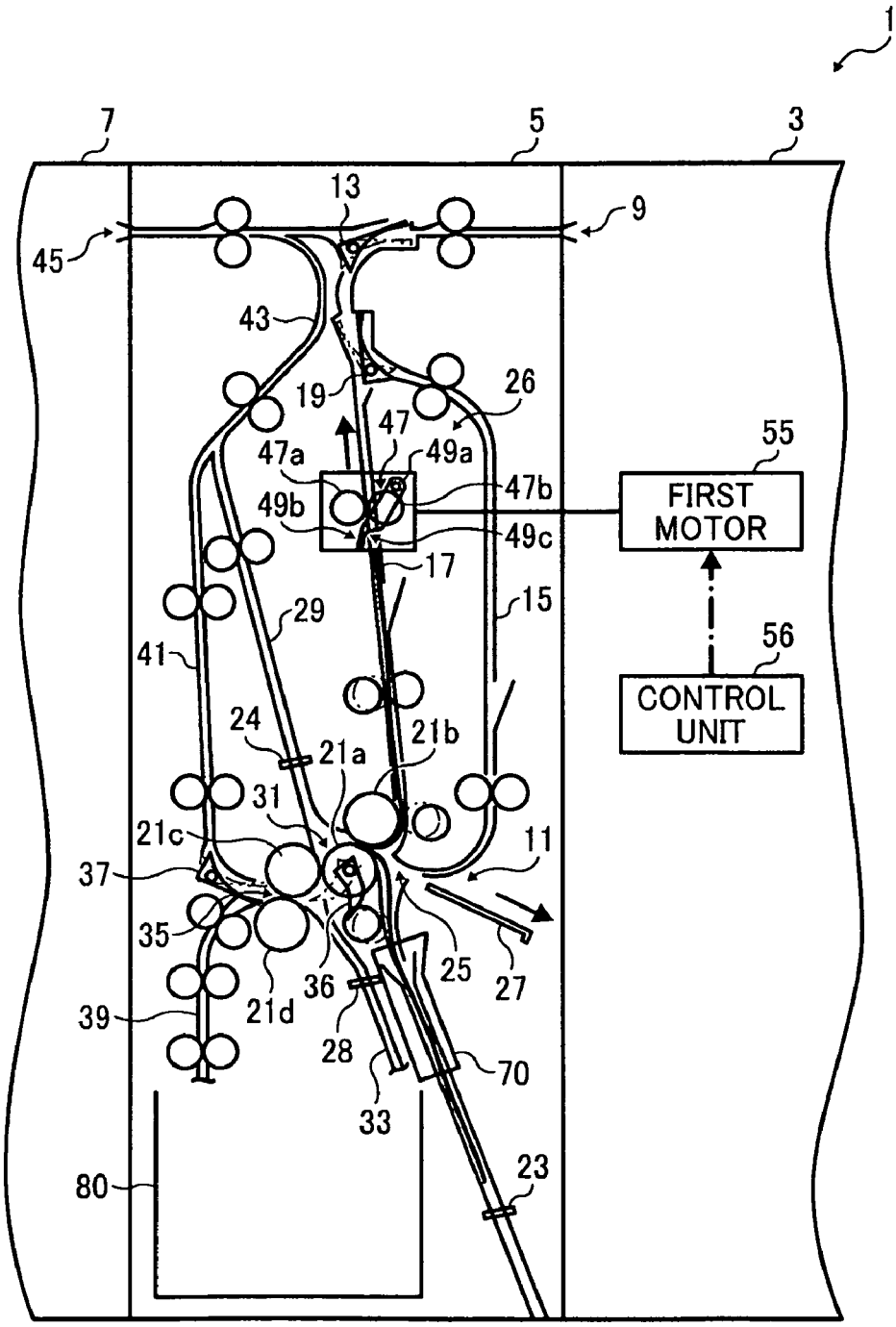
FIG. 7 is a schematic of an operation of the moving roller unit being moved to a sheet receiving position after the bent portion of the sheet bundle is nipped in the first folding nip.

Subsequently, when the bent portion of the sheet bundle is nipped by the first folding nip 25 as illustrated in FIG. 7, the control unit 56 moves up the moving roller unit 26 (toward the upstream side in the sheet conveying direction), and moves the pushing member 27 to the escaped position, so that the moving roller unit 26 and the pushing member 27 are moved away from the trailing edge of the sheet bundle and return to the receiving positions (initial positions) for receiving a sheet.

The fourth switching claw 37 guides the sheet bundle that is half-folded by the first pair of folding rollers to the sixth feed path 41 when the bundle is to be conveyed to the sheet binding apparatus 7, or to the fifth feed path 39 when the bundle is to be conveyed to the stacker 80.

A sheet folding apparatus that is a comparative example of a sheet post-processing apparatus will now be explained with reference to FIG. 8.

A sheet with an image formed thereon is delivered from the image forming apparatus body 3 through the sheet receiving opening 9. The sheet thus delivered is guided by the first switching claw 13 and the second switching claw 19 to the second feed path 17, and the leading edge of the sheet enters the conveying nip 50 of the pair of rubber carriage rollers 47 including the rubber carriage roller 47*d* and the rubber carriage roller 47*b*. The leading edge of the sheet then abuts against the guiding surface 49*b* on the pressing member 49, pushes the pressing member 49 away, and is carried forward toward the downstream side in the sheet conveying direction (see the state (a) in FIG. 8).

Figure 8:
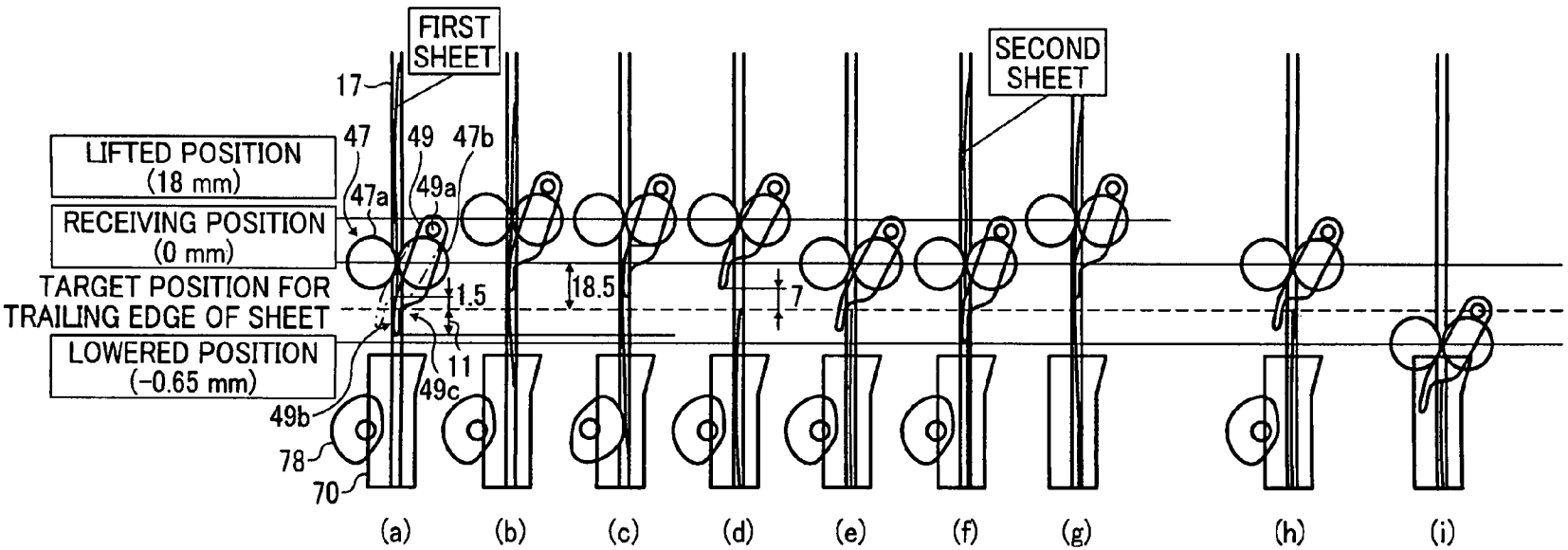
FIG. 8 is a schematic of an operation of a moving roller unit performed when a sheet is conveyed into a second feed path according to a comparative example.

After the leading edge of the sheet passes through the guiding surface 49*b* formed on the edge of the pressing member 49, the control unit 56 rotates the first motor 55 in the positive direction to move up the moving roller unit 26 by 18 millimeters (toward the upstream side in the sheet conveying direction) (see the state (b) in FIG. 8).

At this time, the sheet passes through the jogger 70. The jogger 70 is kept at the receiving position (paper width+7 millimeters).

Once the trailing edge of the sheet passes through the conveying nip 50, the control unit 56 rotates a transfer roller 78 to convey the sheet to the first stopper 23 using the transfer roller 78 (see the state (c) in FIG. 8).

As to the positional relationship between the sheet and the pressing member 49 after the sheet is conveyed by the transfer roller 78, the edge of the pressing member 49 is located 7 millimeters higher than the trailing edge of the sheet (see the state (d) in FIG. 8).

When 50 milliseconds elapse from the time when the leading edge of the sheet reaches the first stopper 23, the control unit 56 rotates the first motor 55 in the reverse direction to move down the moving roller unit 26 by 18 millimeters (toward the downstream side in the sheet conveying direction) (see the state (e) in FIG. 8), and the pressing surface 49*c* of the pressing member 49 presses the trailing edge of the sheet while covering the same.

When the moving roller unit 26 receives the second sheet conveyed thereto, the leading edge of the sheet abuts against the guiding surface 49*b* of the pressing member 49, pushes the pressing member 49 away, and is carried forward as illustrated in the state (f) in FIG. 8 in the same manner as the first sheet. The control unit 56 rotates the first motor 55 in the positive direction at the operational timing at which the leading edge of the sheet passes through the guiding surface 49*b* formed on the edge of the pressing member 49 in the same manner as for the first sheet to move up the moving roller unit 26 by 18 millimeters (toward the upstream side in the sheet conveying direction) (see the state (g) in FIG. 8).

At this time, because the trailing edge of the first sheet is covered by the edge of the pressing member 49, the leading edge of the second sheet is guided by the guiding surface 49*b* and conveyed toward the first sheet without colliding with the trailing edge of the first sheet (accumulated sheet).

When the trailing edge of the sheet passes through the conveying nip 50, the control unit 56 rotates the transfer roller 78 to convey the sheet to the first stopper 23 using the transfer roller 78. When 50 milliseconds elapse from the time when the leading edge of the sheet reaches the first stopper 23, the control unit 56 rotates the first motor 55 in the reverse direction to move down the moving roller unit 26 by 18 millimeters (toward the downstream side in the sheet conveying direction) (see the state (h) in FIG. 8), and the pressing surface 49*c* of the pressing member 49 presses the trailing edge of the sheet while covering the same.

For the third and subsequent sheets, the control unit 56 operates the moving roller unit 26 at the same operational timings to accumulate the sheets in the second feed path 17.

After accumulating a desired number of sheets in the second feed path 17, the control unit 56 rotates the first motor 55 in the reverse direction to move the pressing member 49 to a position 4.5 millimeters below the receiving position, so that the sheet bundle is aligned by the pressing surface 49*c* in the length direction (sheet conveying direction). At the same time, the control unit 56 causes the jogger 70 to align the sheet bundle in the sheet width direction (see the state (i) in FIG. 8).

At this time, the jogger 70 presses the sheets 2 millimeters further inside of the paper width, taking variations in the sheet width into consideration. The control unit 56 then drives the pushing member 27 to cause the pushing member 27 to press the bent portion of the sheet bundle into the first folding nip 25 to fold the sheet bundle.

Subsequently, when the bent portion of the sheet bundle is nipped by the first folding nip 25 as illustrated in FIG. 7, the control unit 56 moves up the moving roller unit 26 (toward the upstream side in the sheet conveying direction), moves the pushing member 27 to the escaped position, and moves the moving roller unit 26 and the pushing member 27 away from the trailing edge of the sheet bundle to the receiving position (initial position) for receiving a sheet.

The sheet folding apparatus according such a comparative example has a structure in which the transfer roller 78 is used to draw a sheet, and to cause the leading edge of the sheet to abut against the first stopper 23. In such a structure, the transfer roller 78 may slip on the surface of the sheet to cause a defective conveyance, thereby not permitting the trailing edge of the sheet to pass through the trailing edge pressing claw. If the trailing edge of the sheet cannot pass through the trailing edge pressing claw, the next sheet may collide with the trailing edge of the previous sheet, resulting in jamming. Furthermore, the moving roller unit 26 and the jogger 70 are used to align the sheets messed up in the pre-stacking process altogether in the sheet length direction and the sheet width direction. However, because the resistance between the sheets in the sheet bundle is large, the sheet bundle cannot be aligned sufficiently. If individual sheets in the sheet bundle are not sufficiently aligned in the length direction, the sheets in the sheet bundle would be at different positions in the sheet conveying direction, and the stacked sheet folding may result in deviations in the folding position. In addition, if individual sheets in the sheet bundle are not sufficiently aligned in the width direction, the sheets may collide with the wall of the feed path or the like while being conveyed to cause skews in some of the sheets, and the stacked sheet folding may cause deviations in the folding position.

On the contrary, the sheet folding apparatus according to the embodiment has a structure in which the sheet is reliably conveyed using the pair of rubber carriage rollers 47, and the pressing surface 49*c* of the pressing member 49 is used to press the trailing edge of the sheet, so that the sheet is conveyed until the leading edge of the sheet abuts against the first stopper 23. Therefore, the jamming mentioned above can be avoided. Furthermore, such a structure can prevent the sheet having its trailing edge passed through the pair of rubber carriage rollers 47 from moving toward the first stopper 23 solely by its own weight. Therefore, unlike the conventional example, skews in the sheet can be prevented, as well as the leading edge of the sheet can be prevented from not being able to reach the first stopper 23. Furthermore, the structure according to the embodiment does not require the separate transfer roller 78 included in the sheet folding apparatus according to the comparative example. Therefore, an inexpensive and small sheet folding apparatus can be provided. Moreover, the sheet is aligned in the sheet length direction and the sheet width direction when there is only one sheet, that is, while the resistance between the sheets is small. Therefore, a sheet folding apparatus with a highly precise alignment can be provided. In this manner, deviations in the folding position between the sheets can be suppressed during the stacked sheet folding.

According to the embodiment, the sheet folding apparatus 5 includes the moving roller unit 26 that is a sheet conveying unit that conveys a sheet, the second feed path 17 that is a sheet accumulating feed path disposed on the downstream side of the moving roller unit 26 in the sheet conveying direction and being capable of accumulating therein a plurality of sheets, the first stopper 23 that is a stopping member for stopping the leading edge of the sheet conveyed into the second feed path 17, and the jogger 70 that is a width aligning unit that aligns the width of the sheet stopped by the first stopper 23 and accumulated in the second feed path, and performs the folding process that is a predetermined post-process to the sheet delivered from the image forming apparatus body 3 after the sheets are accumulated temporarily in the second feed path 17. The sheet folding apparatus 5 also includes the control unit 56 that is a control unit that performs control to align the sheet width using the jogger 70 every time the control unit 56 causes the moving roller unit 26 to convey a sheet into the second feed path 17 in which the first stopper 23 stops the leading edge of the sheet and the sheet is accumulated. In other words, every time a sheet is accumulated in the second feed path 17, the jogger 70 aligns the sheet width. In this manner, a sheet laid on another sheet already having its width aligned in the second feed path 17 is aligned with respect to the width of that sheet. Thus, the resistance between the sheets is small and the sheets can be moved easily in the width direction in comparison with an apparatus in which the width of a plurality of sheets is aligned altogether. Therefore, the width of the sheet bundle including a plurality of sheets accumulated in the second feed path 17 can be aligned precisely, and the sheets can be prevented from being folded at deviated positions upon performing the stacked sheet folding.

Furthermore, according to the embodiment, the moving roller unit 26 is disposed movably in the sheet conveying direction to convey a sheet by nipping the sheet in the conveying nip 50 that is a nip of the pair of rubber carriage rollers 47 that is a pair of rollers, and includes the first motor 55 that is a driving unit that drives the moving roller unit 26 to move toward the upstream side or the downstream side in the sheet conveying direction, and the pressing member 49 disposed on the downstream side of the moving roller unit 26 in the sheet conveying direction and arranged movably in synchronization with the moving roller unit 26 to press the trailing edge of the sheet using the first stopper 23. The control unit 56 performs control to move the moving roller unit 26 toward the upstream side in the sheet conveying direction to a position where the pressing member 49 is removed from the sheet after the trailing edge of the sheet passes through the conveying nip 50 of the pair of rubber carriage rollers 47, so that the sheet is conveyed into the second feed path 17, and the leading edge of the sheet is stopped by the first stopper 23. The control unit 56 also performs control to cause the jogger 70 to align the width of the sheet every time a sheet is accumulated in the second feed path 17, and then performs control to move the moving roller unit 26 toward the downstream side in the sheet conveying direction to a position allowing the pressing member 49 to press the trailing edge of the sheet toward the downstream side in the sheet conveying direction. In this manner, after the trailing edge of the sheet passes through the conveying nip 50 of the pair of rubber carriage rollers 47, the jogger 70 aligns the width of the sheet, and the pressing member 49 aligns the sheet in the sheet conveying direction while the sheet is guided with the jogger 70. In this manner, a sheet folding apparatus that is a sheet post-processing apparatus with a high alignment precision can be provided.

Furthermore, according to the embodiment, the control unit 56 controls to cause the jogger 70 to align the width of the sheets while causing the pressing member 49 to press the trailing edge of the sheets after a plurality of sheets is accumulated in the second feed path 17. In this manner, after the width of a single sheet is aligned, the jogger 70 aligns the width of the entire sheet bundle while causing the pressing member 49 to press the trailing edge of the sheet bundle. Therefore, a sheet folding apparatus that is a sheet post-processing apparatus with a higher alignment precision can be provided.

Furthermore, according to the embodiment, the sheet folding apparatus 5 that is a sheet post-processing apparatus includes the moving roller unit 26 that is a sheet conveying unit disposed movably in the sheet conveying direction and conveying a sheet by nipping the sheet by the conveying nip 50 of the pair of rubber carriage rollers 47 that is a pair of rollers, the first motor 55 that is a driving unit that drives the moving roller unit 26 to move toward the upstream side or the downstream side in the sheet conveying direction, the second feed path 17 that is a sheet accumulating feed path disposed at a position on the downstream side of the moving roller unit 26 in the sheet conveying direction and being capable of accumulating therein a plurality of sheets, the first stopper 23 that is a stopping member for stopping the leading edge of the sheet conveyed into the second feed path 17, and the pressing member 49 arranged on the downstream side of the moving roller unit 26 in the sheet conveying direction and arranged movably in synchronization with the moving roller unit 26, and pressing the trailing edge of the sheet stopped by the first stopper 23 so as to provide a folding process that is a predetermined post-process to the sheet delivered from the image forming apparatus body 3 and temporarily accumulated in the second feed path 17. The sheet folding apparatus 5 also includes the control unit 56 that performs control to cause the moving roller unit 26 to move toward the upstream side in the sheet conveying direction to a position where the pressing member 49 is removed from the sheet after the trailing edge of the sheet passes through the conveying nip 50 of the pair of rubber carriage rollers 47, to remove the pressing member 49 from the sheet, and to cause the first motor 55 to move the moving roller unit 26 toward the downstream side in the sheet conveying direction to cause the pressing member 49 to press the trailing edge of the sheet, so that the leading edge of the sheet reaches the first stopper 23. In this manner, in this structure, after the sheet is conveyed reliably with the pair of rubber carriage rollers 47, the sheet can be conveyed until the leading edge of the sheet abuts against the first stopper 23 by causing the pressing surface 49*c* of the pressing member 49 to press the trailing edge of the sheet. Therefore, the jamming mentioned above can be avoided. Furthermore, the sheet folding apparatus 5 does not require the separate transfer roller 78 included in the sheet folding apparatus according to the comparative example. Therefore, an inexpensive and small sheet folding apparatus can be provided. Moreover, the sheet is aligned in the sheet length direction when there is only one sheet, that is, while the resistance between the sheets is small. Therefore, a sheet folding apparatus with a highly precise alignment can be provided. In this manner, deviations in the folding position among the sheets can be suppressed during the stacked sheet folding.

Furthermore, according to the embodiment, it is preferable for the sheet receiving position of the moving roller unit 26 to be a position that allows the pressing member 49 to guide the trailing edge of the sheet.

According to the first to the third aspects of the present invention, every time a sheet is accumulated in the sheet accumulating feed path, the width aligning unit aligns the width of the sheet. In this manner, a sheet laid on another sheet already having its width aligned in the sheet accumulating feed path is aligned with respect to the width of that sheet. Thus, the resistance between the sheets is small and the sheets can be moved easily in the width direction in comparison with an apparatus in which the width of a plurality of sheets is aligned altogether. Therefore, the width of the sheet bundle including a plurality of sheets accumulated in the sheet accumulating feed path can be aligned precisely, and the sheets can be prevented from being folded at deviated positions upon performing the stacked sheet folding.

According to the fourth and the fifth aspects of the present invention, after the trailing edge of the sheet passes through the pair of rollers included in the sheet conveying unit, the driving unit moves the sheet conveying unit to a position where the pressing member is removed from the sheet on the upstream side in the sheet conveying direction so as to let the pressing member remove from the sheet. In this manner, jamming as mentioned above can be suppressed. In addition, after the sheet is removed from the pressing member, the driving unit moves the sheet conveying unit toward the downstream side in the sheet conveying direction so as to cause the pressing member to press the trailing edge of the sheet, so that the leading edge of the sheet reaches the position of the stopper member. In this manner, the leading edge of the sheet can reach the stopper member reliably. Because a sheet laid on another sheet already aligned in the length direction, by letting the leading edge thereof abut against the stopping member, is aligned with respect to that sheet in the length direction, the resistance between the sheets is small and the sheets can be moved easily in the length direction in comparison with an apparatus in which the length of a plurality of sheets is aligned altogether. Therefore, the length of the sheet bundle including a plurality of sheets accumulated in the sheet accumulating feed path can be aligned precisely, and the sheets can be prevented from being folded at deviated positions upon performing the stacked sheet folding. According to the first to the third aspects of the present invention, the width of the sheet bundle accumulated in the feed path can be aligned precisely, and the sheets can be prevented from being folded at deviated positions upon performing stacked sheet folding, advantageously.

According to the fourth and the fifth aspects of the present invention, jamming can be prevented, and the sheet bundle accumulated in the feed path can be aligned in the length direction more precisely. Thus, the sheets can be prevented from being folded at deviated positions upon performing the stacked sheet folding, advantageously.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet post-processing apparatus that performs a post-process to a sheet delivered from an image forming apparatus and accumulated temporarily, the sheet post-processing apparatus comprising:

a sheet conveying unit that conveys a sheet;

a sheet accumulating feed path that is arranged on a downstream side of the sheet conveying unit in a sheet conveying direction and being capable of accumulating therein a plurality of sheets;

a stopping member that stops a leading edge of a sheet conveyed into the sheet accumulating feed path;

a width aligning unit that aligns a width of the sheet stopped by the stopping member and accumulated in the sheet accumulating feed path;

a plurality of pressing members that are arranged at a position on the downstream side of the sheet conveying unit in the sheet conveying direction and arranged to be movable toward an upstream side or a downstream side in the sheet conveying direction along the feed path; and a control unit that performs control to cause: the sheet conveying unit to convey a sheet into the sheet accumulating feed path; the stopping member to stop the leading edge of the sheet; and the width aligning unit to align the width of a sheet every time a sheet is accumulated in the sheet accumulating feed path, wherein:

the sheet conveying unit is arranged movably in the sheet conveying direction and conveys a sheet by nipping the sheet by a nip of a pair of rollers, the sheet post-processing apparatus further includes a driving unit that drives the sheet conveying unit to the upstream side or the downstream side in the sheet conveying direction, the plurality of pressing members that are arranged movably in synchronization with the sheet conveying unit, press down a trailing edge of the sheet stopped by the stopping member, and the control unit performs control to cause: the sheet conveying unit to move toward the upstream side in the sheet conveying direction to a position where the plurality of pressing members are away from the sheet after the trailing edge of the sheet passes through the nip of the pair of rollers, so that the sheet is conveyed into the sheet accumulating feed path; and the sheet conveying unit to move toward the downstream side in the sheet conveying direction to a position where the plurality of pressing members press down the trailing edge of the sheet toward the downstream side in the sheet conveying direction.

2. The sheet post-processing apparatus according to claim 1, wherein the control unit controls to cause the width aligning unit to align the width of the sheet while causing the plurality of pressing members to press the trailing edge of the sheet after a plurality of sheets is accumulated in the sheet accumulating feed path.

3. A sheet post-processing apparatus that performs a post-process to a sheet delivered from an image forming apparatus and accumulated temporarily, the sheet post-processing apparatus comprising:

a sheet conveying unit that is arranged movably in a sheet conveying direction and conveys a sheet by nipping the sheet by a nip of a pair of rollers;

a driving unit that drives the sheet conveying unit to move toward an upstream side or a downstream side in the sheet conveying direction;

a sheet accumulating feed path that is arranged on the downstream side of the sheet conveying unit in the sheet conveying direction and is capable of accumulating therein a plurality of sheets;

a stopping member that stops a leading edge of a sheet conveyed into the sheet accumulating feed path;

a pressing member that is arranged on the downstream side of the sheet conveying unit in the sheet conveying direction and arranged movably in synchronization with the sheet conveying unit, and presses down the trailing edge of the sheet stopped by the stopping member; and a control unit that performs control to cause: the sheet conveying unit to move toward the upstream side in the sheet conveying direction to a position where the pressing member is away from the sheet after the trailing edge of the sheet passes through the nip of the pair of rollers, so that the pressing member is removed from the sheet; and the driving unit to move the sheet conveying unit toward the downstream side in the sheet conveying direction to cause the pressing member to press down the trailing edge of the sheet, so that the leading edge of the sheet reaches the stopper member.

4. The sheet post-processing apparatus according to claim 3, wherein a sheet receiving position of the sheet conveying unit is arranged at a position that allows the pressing member to guide the trailing edge of the sheet.

* * * * *